US007325691B2

(12) United States Patent
Siy et al.

(10) Patent No.: US 7,325,691 B2
(45) Date of Patent: Feb. 5, 2008

(54) PACKAGING APPARATUS

(75) Inventors: John P. Siy, Fairport, NY (US); Kevin R. Barrell, Hilton, NY (US); Julie S. Machell, Webster, NY (US); Frances P. Masiewicz, Rochester, NY (US); Kevin M. Metzger, Hilton, NY (US); Damijan Vujanovic, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 450 days.

(21) Appl. No.: 10/957,769

(22) Filed: Oct. 4, 2004

(65) Prior Publication Data

US 2006/0070904 A1 Apr. 6, 2006

(51) Int. Cl.
*B65D 19/00* (2006.01)

(52) U.S. Cl. ..... 206/600

(58) Field of Classification Search ..... 206/386, 206/389, 395, 397, 407, 408, 413, 415, 600; 108/51.3, 55.1, 55.3, 56.1, 56.3; 220/1.5, 220/4.28

See application file for complete search history.

(56) References Cited

U.S. PATENT DOCUMENTS 3,327,882 A * 6/1967 Andrews ..... 220/4.28
3,564,112 A * 2/1971 Algotsson et al. ..... 220/3.92
3,796,340 A * 3/1974 Piggott ..... 206/600
4,027,794 A 6/1977 Olson
4,042,107 A * 8/1977 Kendig ..... 206/408
4,239,149 A 12/1980 Kupersmit
4,252,266 A 2/1981 Kupersmit
4,358,048 A 11/1982 Kupersmit
4,358,049 A 11/1982 Kupersmit
4,401,217 A 8/1983 Blatt
4,405,077 A 9/1983 Kupersmit
4,411,373 A 10/1983 Kupersmit
4,662,532 A 5/1987 Anderson et al.
6,079,560 A * 6/2000 Champion ..... 206/386
6,966,449 B2 * 11/2005 Williams ..... 206/600

FOREIGN PATENT DOCUMENTS

DE 197 56 623 4/1999
JP 2002104416 4/2002

* cited by examiner

*Primary Examiner*—Luan K. Bui
(74) *Attorney, Agent, or Firm*—Chris P. Konkol

(57) ABSTRACT

A packaging apparatus includes a base having first ridges and second ridges. The packaging apparatus also include end portions, each of which has a plurality of slots and channels. Each of the channels is adapted to receive one of the first ridges and each of the slots is adapted to receive one of the second ridges. The packaging apparatus also includes a sleeve, which is adapted to be disposed over the base and exteriorly to the first and second ridges. At least a portion of the sleeve element and at least a portion of the end portions comprise a corrugated material.

43 Claims, 18 Drawing Sheets

PACKAGING APPARATUS

FIELD OF THE INVENTION

Embodiments of the present invention relate to a packaging apparatus.

BACKGROUND OF THE INVENTION

Packaging a product for safe shipment may be done in a variety of ways and using many different materials depending on the type of product being shipped. For example, optical films are often manufactured in long sheets. The sheets may be rolled about a cylindrical core and disposed in a box-type package for shipping. Often, the core is mounted at opposing ends of the package. This arrangement prevents the rolled film from contacting the bottom of the package. To this end, the roll of film may weigh over 1000 lbs. (a mass of approximately 450 kg.); if allowed to rest on itself or even contact the bottom of the package, the roll may be damaged from impressions or indentations. In many applications, this is to be avoided.

Often, known packaging of rolls of optical film is effected using a box-type package that is assembled of a material such as metal or wood. After the package has been shipped, the receiver must remove the rolls and return the box for reuse by the shipper. To wit, the package must be opened with tools and often stored until there are enough to make it economically feasible to ship the boxes back to the shipper.

In addition to the logistical complexity of having to store and return the packaging boxes, the cost and complexity of these known packaging techniques pose significant drawbacks. As to the former, the costs of returning the boxes can be prohibitive. As to the latter, the required tools and manpower needed to disassemble the known packaging boxes to remove the rolls render the known boxes undesirable.

What is needed, therefore, is a packaging apparatus that overcomes at least the drawbacks of the known packing boxes referenced above.

SUMMARY OF THE INVENTION

In accordance with an example embodiment, a packaging apparatus includes a base having first ridges and second ridges, wherein the first ridges are substantially perpendicular to the second ridges. The apparatus also includes end portions, each of which has a plurality of slots and channels, wherein each of the channels are adapted to receive one of the first ridges and each of the slots are adapted to receive one of the second ridges. In addition, the apparatus includes a sleeve, which is adapted to be disposed over the base and interiorly to the first ridges. In an illustrative embodiment, at least a portion of the sleeve and at least a portion of the end portions comprise a corrugated material.

In accordance with another example embodiment, a packaging apparatus includes a base having first ridges and second ridges. The packaging apparatus also include end portions, each of which has a plurality of slots and channels. Each of the channels is adapted to receive one of the first ridges and each of the slots is adapted to receive one of the second ridges. The packaging apparatus also includes a sleeve, which is adapted to be disposed over the base and exteriorly to the first and second ridges. At least a portion of the sleeve element and at least a portion of the end portions comprise a corrugated material.

BRIEF DESCRIPTION OF THE DRAWINGS

The invention is best understood from the following detailed description when read with the accompanying drawing figures. It is emphasized that the various features are not necessarily drawn to scale. In fact, the dimensions may be arbitrarily increased or decreased for clarity of discussion.

DETAILED DESCRIPTION OF THE INVENTION

In the following detailed description, for purposes of explanation and not limitation, example embodiments disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known apparati and methods may be omitted so as to not obscure the description of the example embodiments. Such methods and apparati are clearly within the contemplation of the inventors in carrying out the example embodiments. Wherever possible, like numerals refer to like features throughout.

Briefly, and as described in accordance with example embodiments, a package for shipping material is described and requires substantially no tools to assemble, provides rapid assembly and disassembly, and provides sufficient strength in shipping rolls of materials. Additionally, when disassembled, the box has a compact size and is readily stored with all component parts enclosed. In an example embodiment, the material is disposed over a cylindrical or tubular element (often referred to herein as a core), thus forming a roll of the material.

In keeping with example embodiments, the roll of material can be formed in various sizes up to a maximum size that will fit in the box. Of course, this is merely illustrative, and other article(s) being contained can be larger or smaller in physical stature.

Illustratively, the material disposed in the packaging apparatus is one of an optical film, an acetate, fabric, a roll of thin metal, paper, or other material that can be formed in a roll for shipping. Moreover, article(s) being shipped may include engine parts or other mechanical parts that are assembled around a central, tubular and/or cylindrical shaft.

Beneficially, the package of the example embodiments comprises a corrugated material, such as corrugated cardboard that provides sufficient strength, but may be collapsed and easily recycled rather than returned to the shipper. These and other benefits will be apparent to one of ordinary skill in the art having had the benefit of the present disclosure. As used herein, the term "corrugated material" is a material having at least one surface that comprises substantially parallel and alternating ridges and grooves; for example, folds or wrinkling, as will be understood by the skilled artisan.

FIGS. 1*a*-1*h* are perspective views of various components of a package 100 in accordance with example embodiments. The components, when assembled, comprise the package 100, which is shown in completed form in FIG. 1*g*.

Figure 1A:
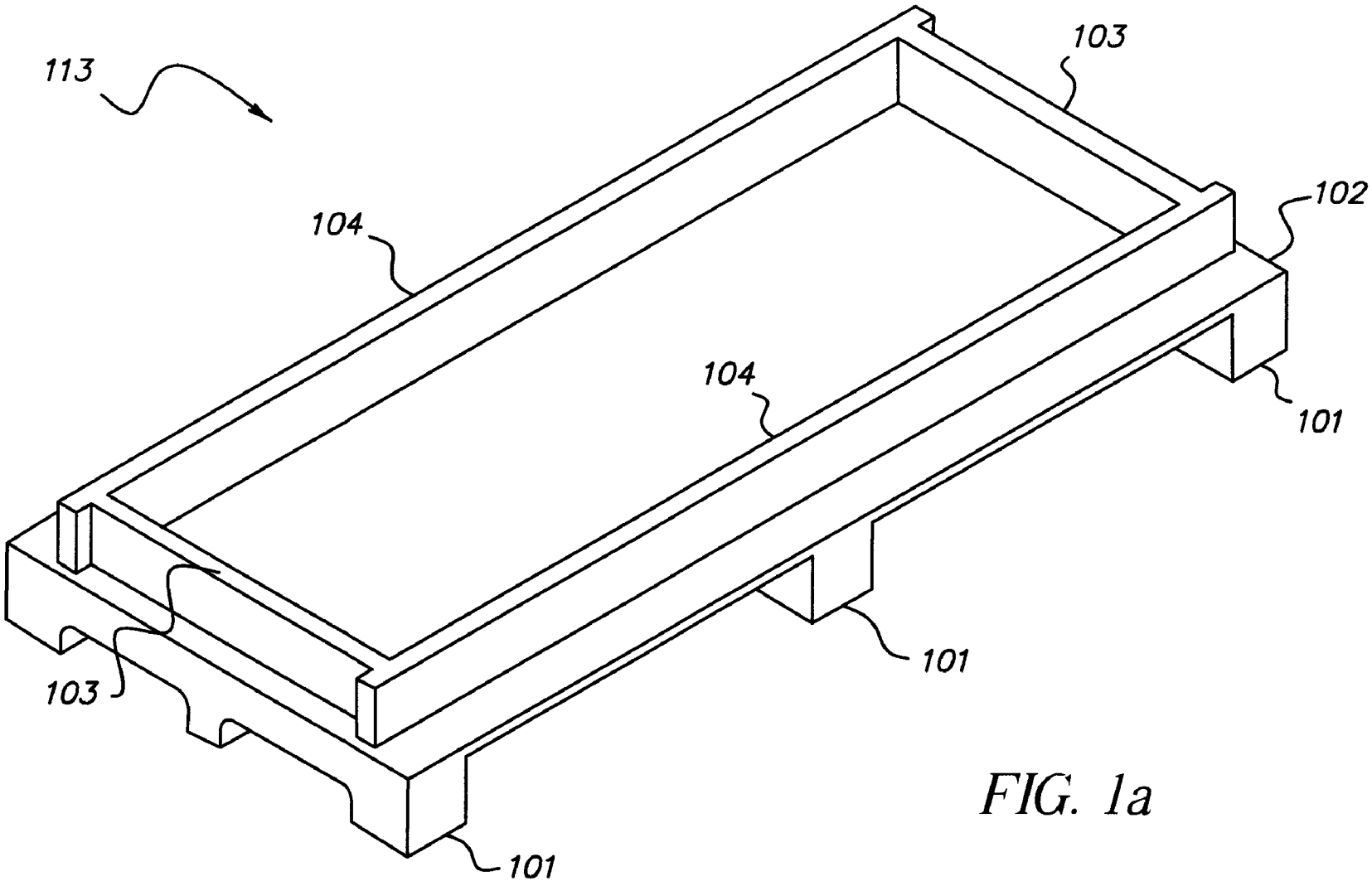
FIG. 1*a* is a perspective view of a base of a package in accordance with an example embodiment.

Turning initially to FIG. 1*a*, a base 113 includes supports 101, which have a platform 102 disposed thereover. The platform 102 has first ridges 103 and second ridges 104 disposed thereover. As can be appreciated from a review of FIG. 1*a*, the first ridges 103 are substantially parallel to one another and are substantially each perpendicular to second ridges 104, which are substantially parallel to one another. In the example embodiment shown in FIGS. 1*a*-1*h*, the base 113 is substantially rectangular in shape. However, the base 113 (and thus the package 100) may be of other shapes than those shown. For example, the base may be substantially square. Of course, other shapes are possible depending on the need of the shipper; and the ridges do not need to be parallel and perpendicular as described above. Rather, and as will become clearer as the present description continues, the ridges must engage channels and grooves to provide structural strength to the package, and to foster rapid assembly and disassembly without the necessity of tools.

In an example embodiment, the supports 101, the platform 102 and the first and second ridges 103 and 104, respectively, are made of wood. For example, the supports and the ridges may be made of 4×4 wood beams and 2×4 wood planks and the platform 102 may be plywood. Of course, the use of wood is merely illustrative, and other materials including, but not limited to engineered and laminated wood materials, plastic, metal, fiberglass and other composite materials, extruded plastics, and "plastic lumber" may be used to form the components of the base 113.

Figure 1B:
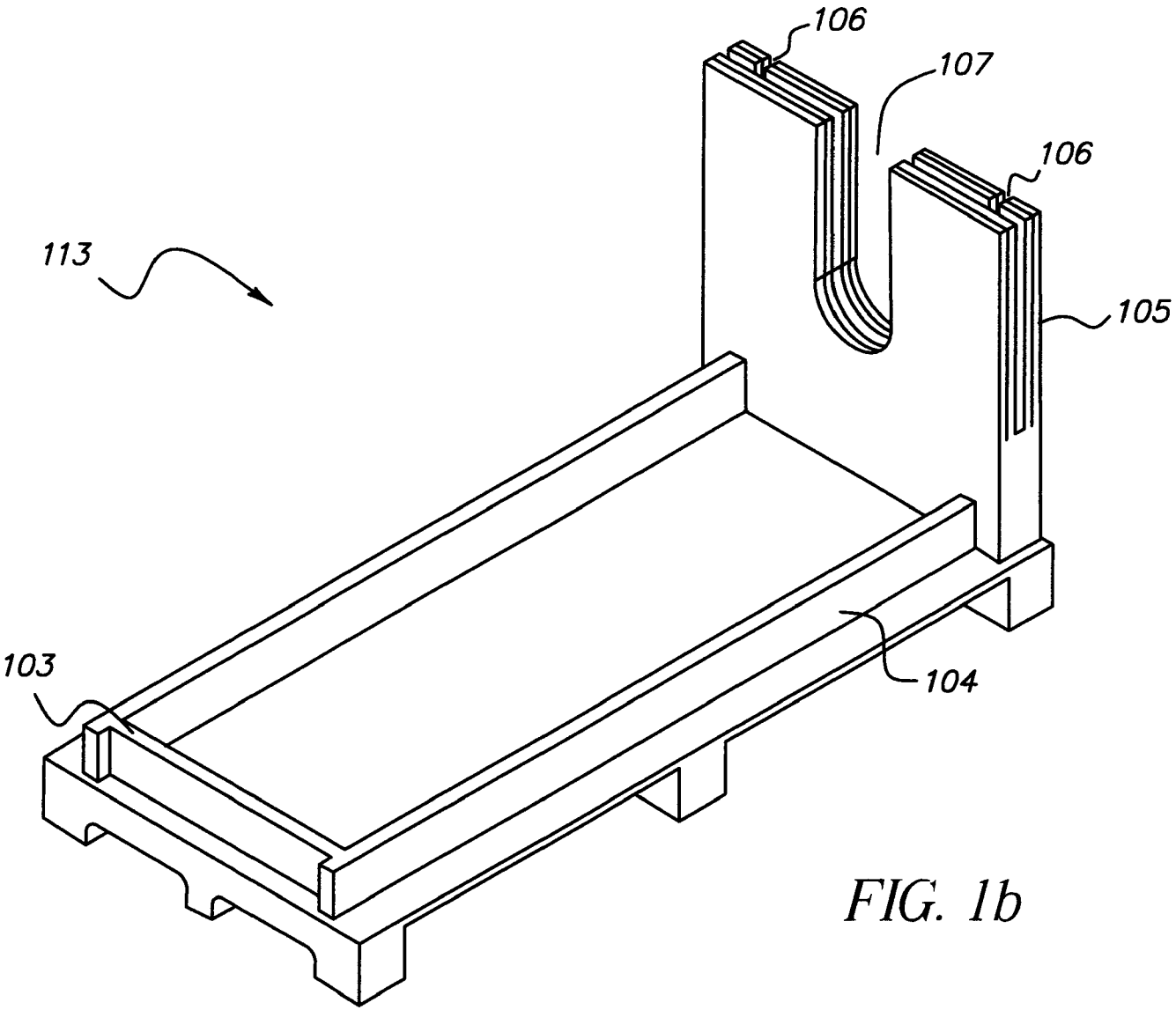
FIG. 1*b* is a perspective view of the base of a package with one of the end portions mounted thereon in accordance with an example embodiment.
Figure 2:
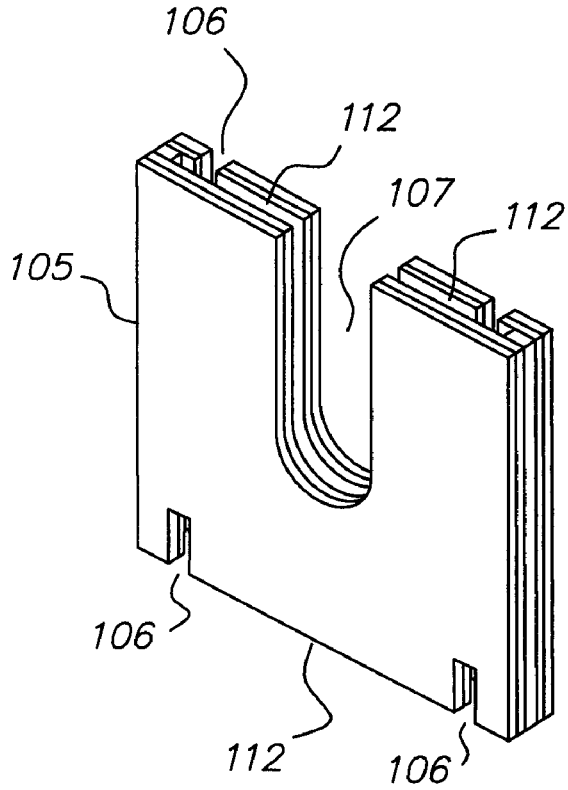
FIG. 2 is a perspective view of an end portion in accordance with an example embodiment.

FIG. 1*b* shows the base 113 having an end portion 105 disposed at one end. The end portion 105 includes at least one slot 106 and at least one opening 107. Shown in greater detail in FIG. 2, the end portion 105 also includes at least one channel 112. It is noted that the slots 106 and channels 112 are also disposed on the opposite end of the end portion 105. Returning to FIG. 1*b*, the slots 106 engage the second ridges 104. To this end, the slots 106 are positioned on the end portion 105 in order to engage the second ridges 104, and have a depth that is approximately the height of the second ridges 104 (e.g., 4 in. if a 2×4 is used). The channel 112 on the lower portion of the end portion 105 is disposed over and engages the first ridge 103. In this manner, structural support is given in the plane of the bottom 113. For example, if the x-direction is parallel to the first ridges 103 and the y-direction is parallel to the second ridges, structural support is given by the slots 106 and channels 112, respectively.

In example embodiments, the end portions 105 are comprised of corrugated material. Illustrative materials include, but are not limited to, corrugated cardboard (paper-based), which may be multi-ply. Alternatively, corrugated plastics, polymers and composite materials may be used. Still alternatively, other materials that provide sufficient strength; are collapsible; foster assembly of the package 100 substantially without tools; and are relatively inexpensive may be used.

Figure 1C:
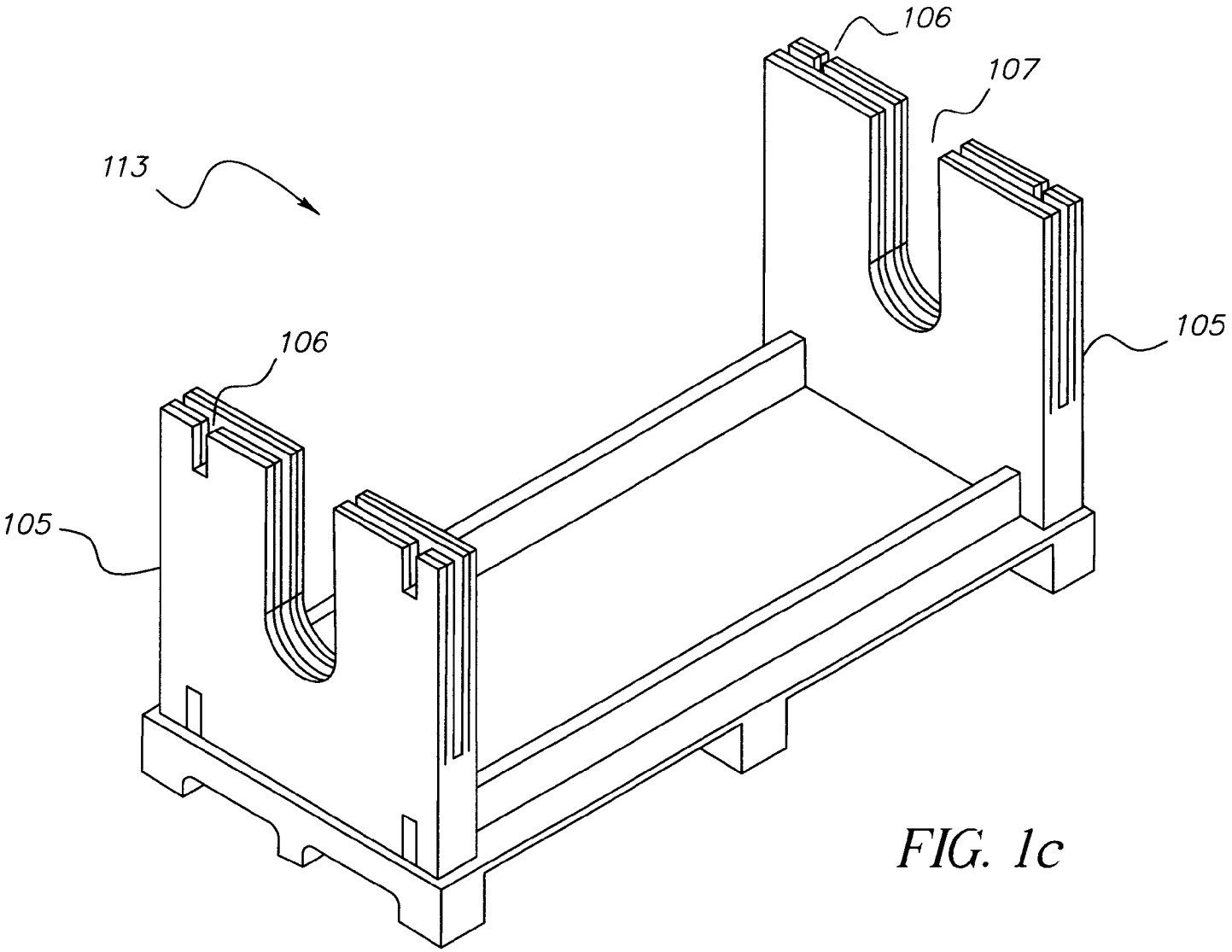
FIG. 1*c* is a perspective view of a base of a package with both end portions mounted thereon in accordance with an example embodiment.
Figure 1D:
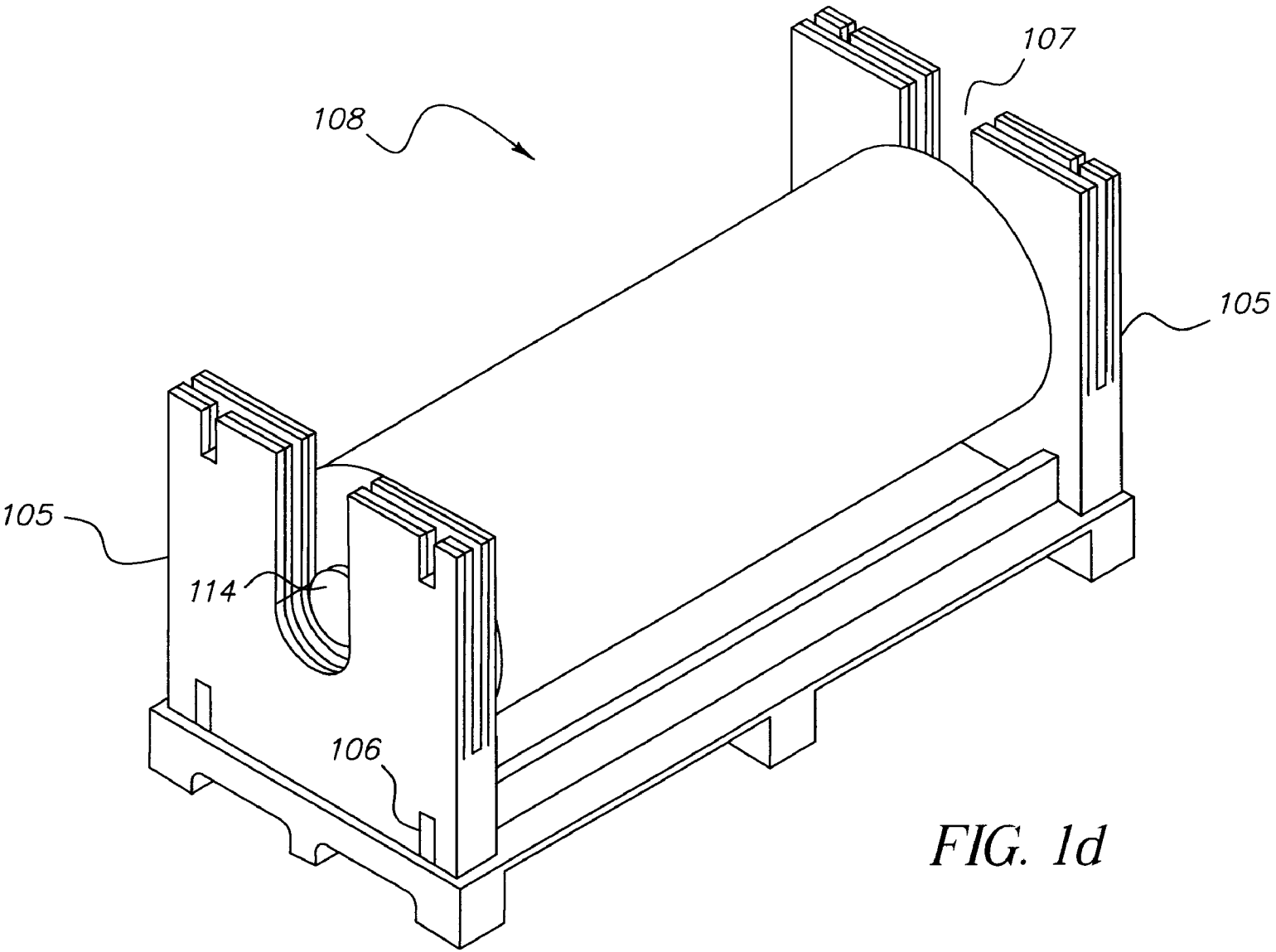
FIG. 1*d* is a perspective view of a package with both end portions mounted on the base and having a roll of material disposed therein in accordance with an example embodiment.

FIG. 1*c* shows another end portion 105 disposed over the base 113. The slots 106 and channels 112 of the end portion 105 engage the first and second ridges, respectively. As shown in FIG. 1*d*, after the second end portion is attached, an article 108 to be shipped is disposed between the two end portions 105. The article 108 is illustratively cylindrical in shape (i.e., a roll) and is disposed over a core 114. However, the article 108 does not need to be cylindrical. Rather, the article 108 may be one of a variety of shapes. Likewise, the core 114 may be other than cylindrical in shape. Alternative shapes include, but are not limited to, elliptical and rectangular. Finally, it is noted that the article 108 need not extend from across the entire length of the interior of the packaging apparatus 100. Rather, it may only extend over a portion of the length of the interior, and thus of the length of the core 114. In this case, it would be useful to incorporate fasteners or spacers (not shown) over the core 114 and adjacent to the ends of the article to avoid movement during shipment.

Figure 1E:
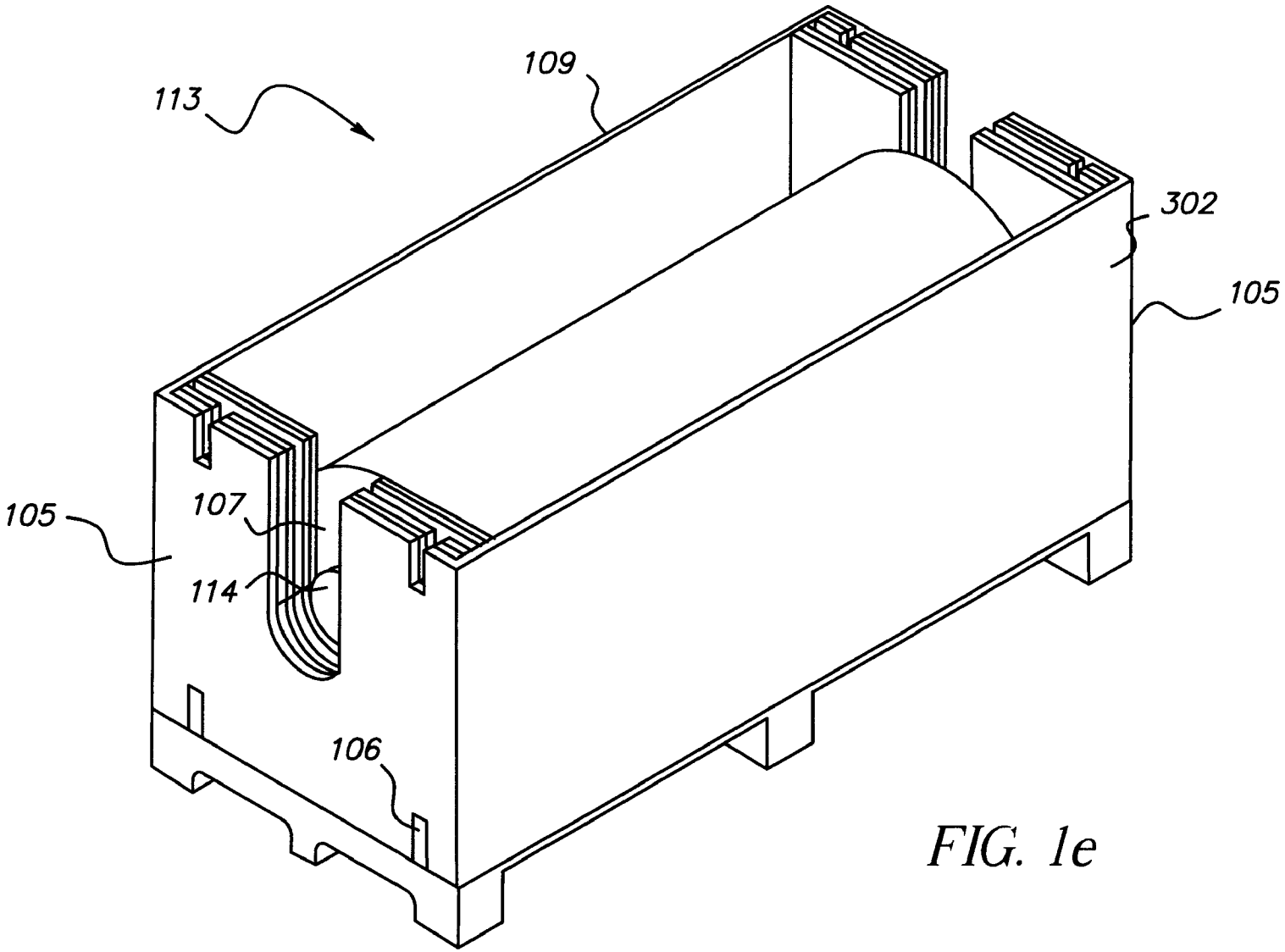
FIG. 1*e* is a perspective view of a base, end portions and sleeve of a package having a roll of material disposed therein in accordance with an example embodiment.

As shown in FIG. 1*e*, the core 114 protrudes slightly through the opening 107, which provides support via the end portions. The weight of the article, which is on the order of 1200 lbs., provides a significant force, which is transferred to the slots 106 and channels 112, which engage the ridges 103 and 104. This engagement of the slots and grooves with the channels and under the force of the weight of the article provides stability to the package structure.

Figure 3:
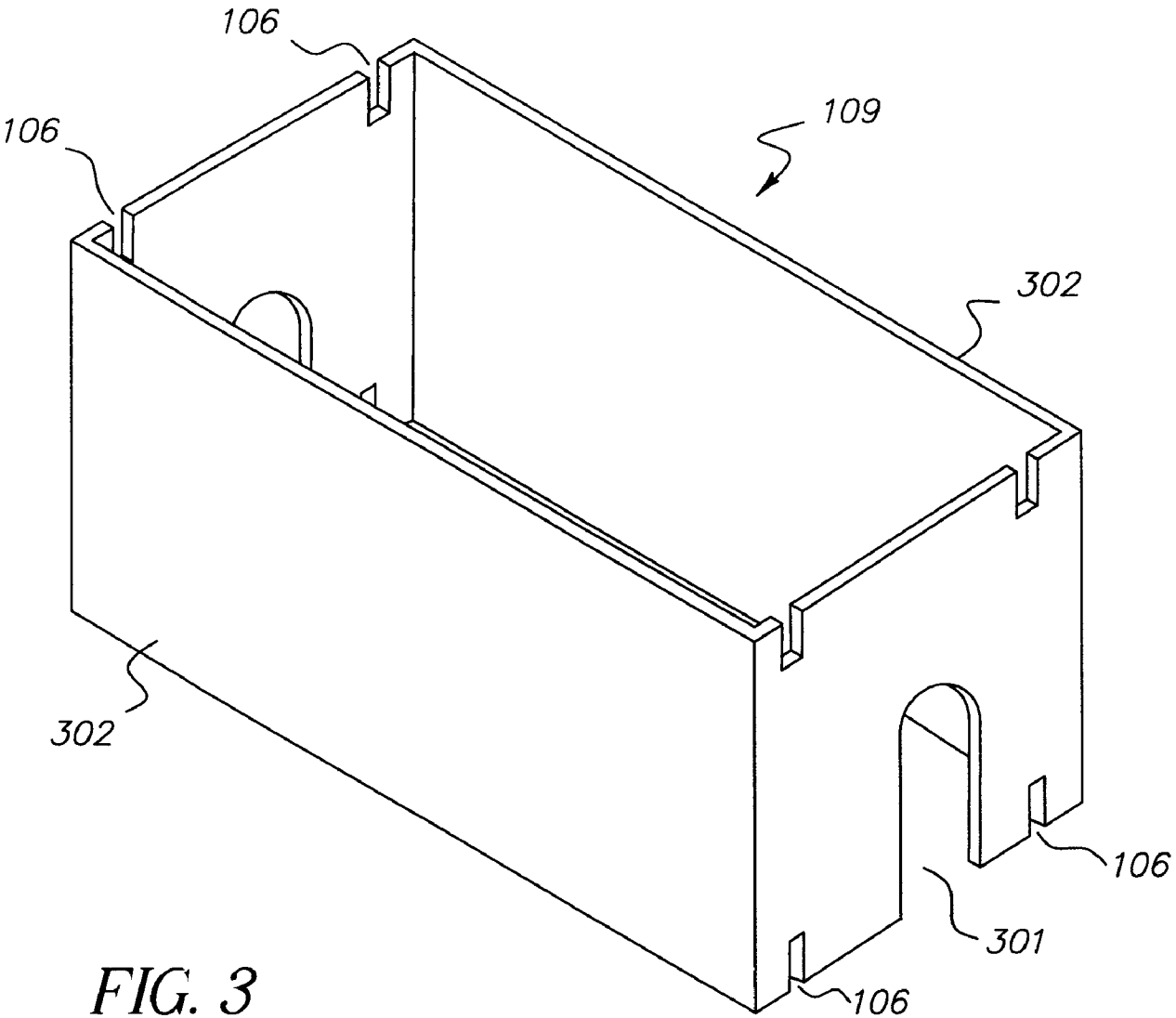
FIG. 3 is a perspective view of a sleeve in accordance with an example embodiment.

FIG. 1*e* shows the package having the sleeve 109 disposed over the base 113 and between the end portions 105. The sleeve 109 is shown in greater detail in FIG. 3; The sleeve 109 has slots 106 on each end and on top and bottom portions as shown. The sleeve also includes an opening 301, which, together with opening 107 of the end portions 105, forms a substantially circular opening through which the core 114 protrudes. Alternatively, the sleeve, when engaged with the end portions may form others opening shapes including rectangular, elliptical, square, triangular, slotted, among others. Finally, the sleeve 109 has sides 302, which form the sides of the package.

Like end portions 105, in example embodiments, the sleeve 109 is comprised of corrugated material. Illustrative materials include, but are not limited to, corrugated cardboard (paper-based), which may be multi-ply. Alternatively, corrugated plastics, polymers and composite materials may be used. Still alternatively, other materials that provide sufficient strength; are collapsible; foster assembly of the package 100 substantially without tools; and are relatively inexpensive may be used.

The sleeve 109 is disposed over the base 113, and its slots 106 engage the second ridges 104. Moreover, in the present example embodiment, the sides 302 are disposed on the outer side of the second ridges 104 and over the base. It is noted that this is not essential, as the sides 302 can be disposed on the interior of the ridges 104. In this case, and as will become clearer as the description continues, a support frame for the top of the package may be eliminated.

Figure 1F:
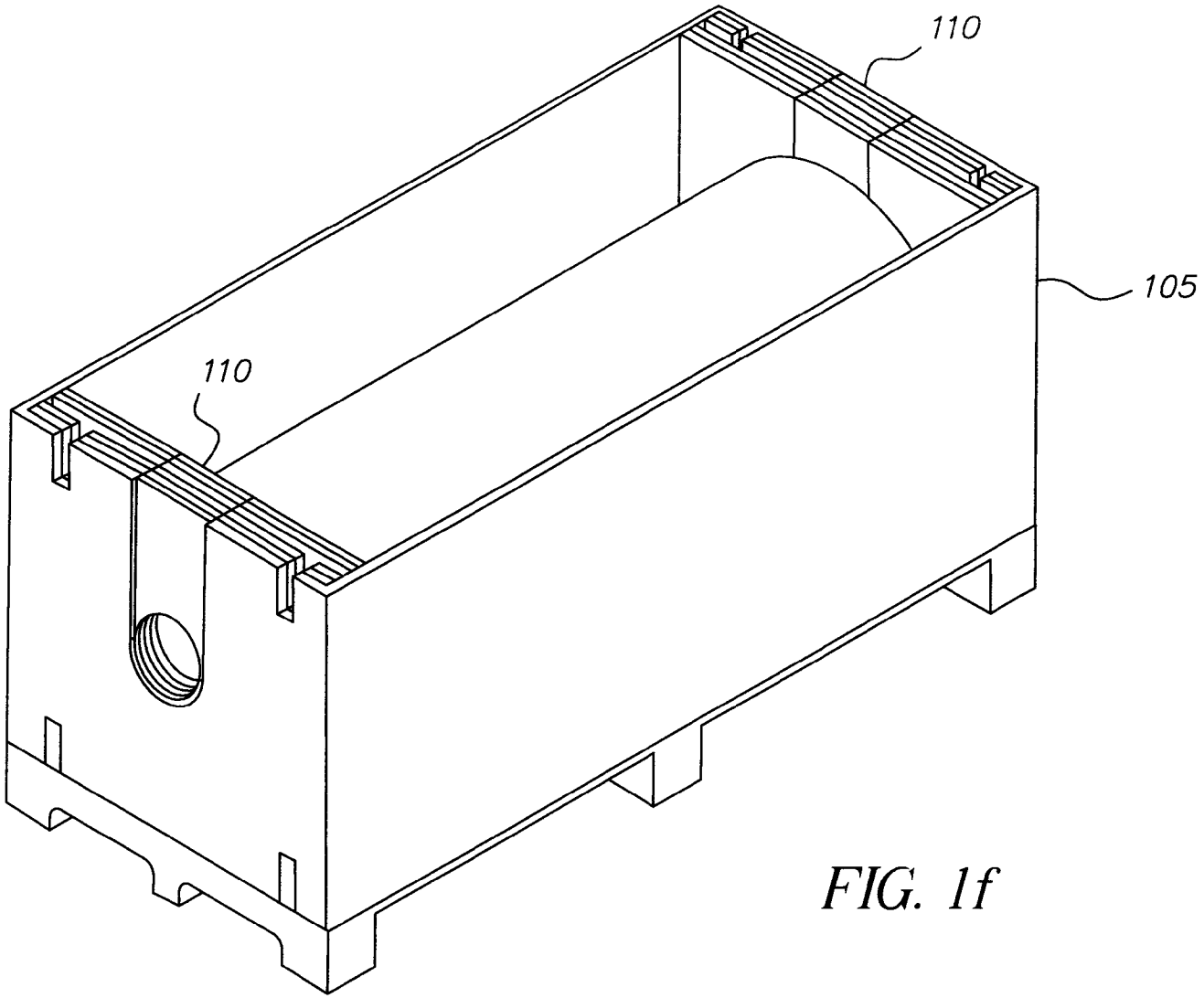
FIG. 1*f* is a perspective view of a base, end portions, sleeve and hold-down of a package having a roll of material disposed therein in accordance with an example embodiment.
Figure 4:
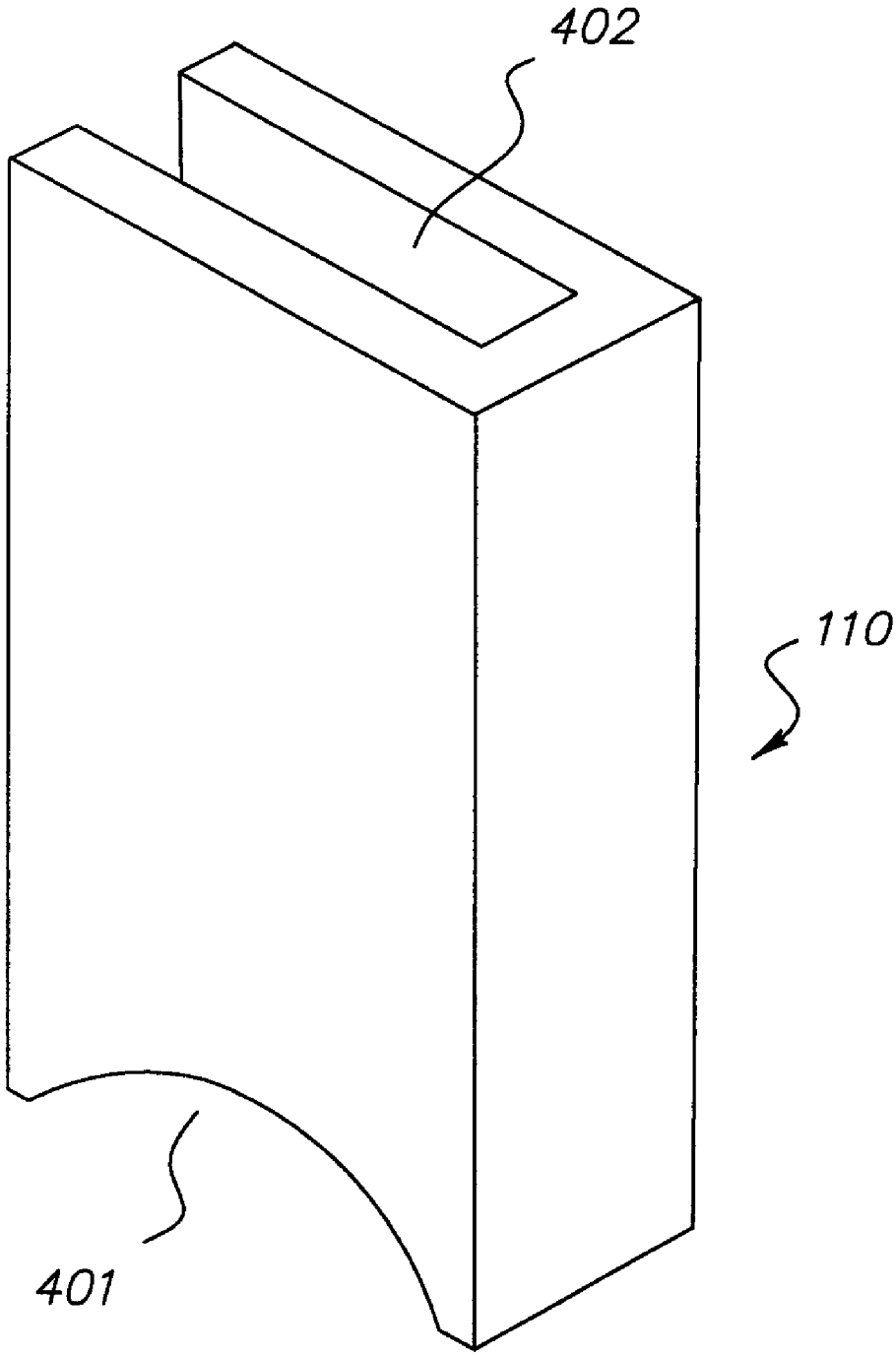
FIG. 4 is a perspective view of a hold down in accordance with an example embodiment.

FIG. 1*f* is a perspective view of the package 100 in nearly completed form. In addition to the other elements thus far described, the package includes a hold down element 110, which is disposed over the core. It is noted that another hold down element 110 is disposed in a similar manner at the opposite end of the package (i.e., at the side of the other end portion 105). Shown in greater detail in FIG. 4, the hold down element 110 includes a curved surface 401 and a channel 402 as shown. The channel is adapted to engage a ridge of a top described herein; and the curved surface 401 is adapted to complement the substantially circular opening of the package through which the core protrudes. Alternatively, the curved surface 401 may be adapted to complement other shaped openings of the package, including rectangular, elliptical, square, triangular, and slotted openings, among others. The mating of the channel 402 with the ridge of the top provides stability of the top of the package.

Like the end portions 105 and the sleeve 109, in example embodiments, the hold downs 110 are comprised of corrugated material. Illustrative materials include, but are not limited to, corrugated cardboard (paper-based), which may be multi-ply. Alternatively, corrugated plastics, polymers and composite materials may be used. Still alternatively, other materials that provide sufficient strength; are collapsible; foster assembly of the package 100 substantially without tools; and are relatively inexpensive may be used.

Figure 1G:
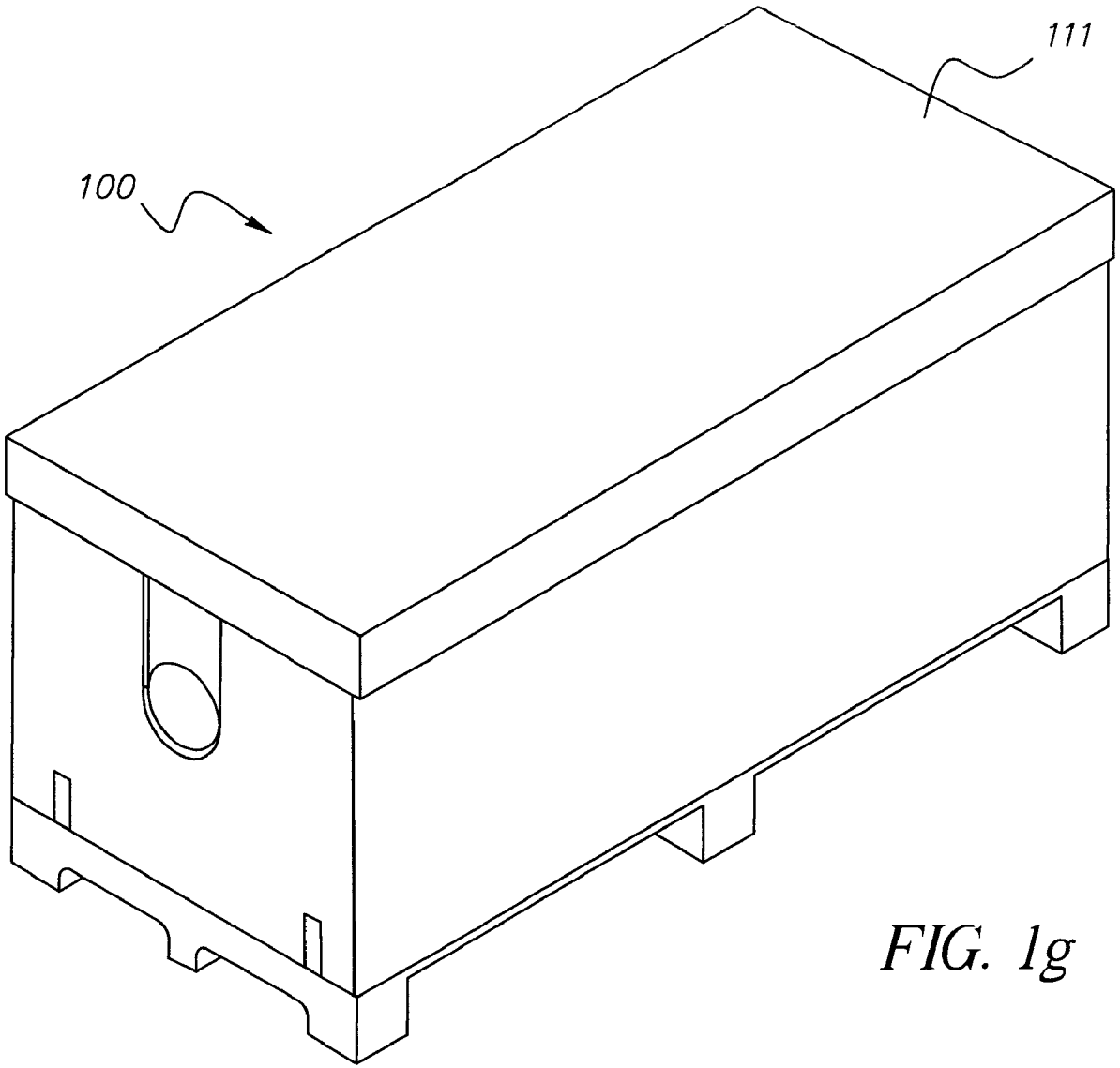
FIG. 1*g* is a perspective view of a package in accordance with an example embodiment.
Figure 5:
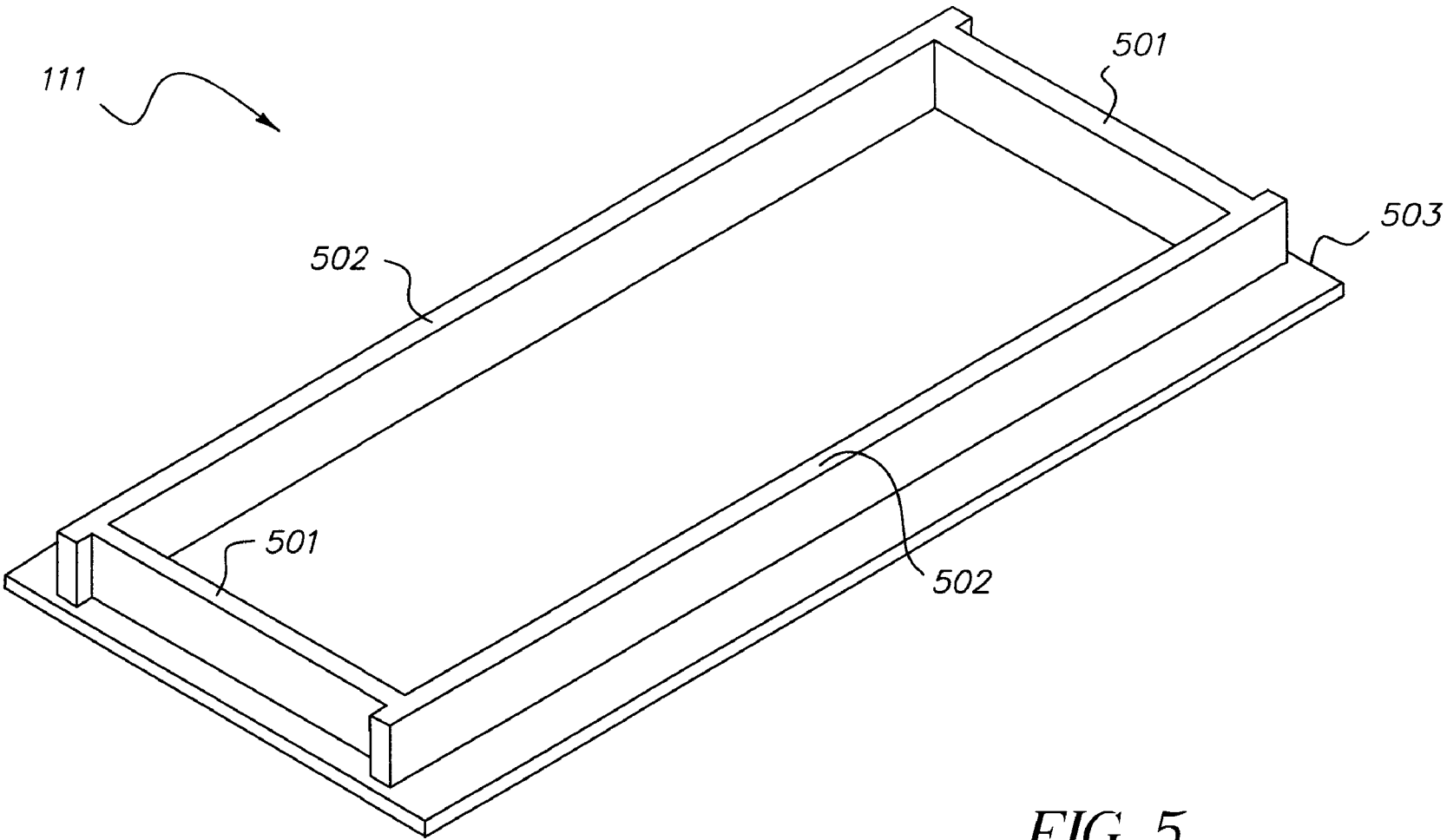
FIG. 5 is a perspective view of a top in accordance with an example embodiment.

FIG. 1*g* shows the final assembly of the package 100, which includes the top 111. Shown in greater detail in FIG. 5, the top includes third ridges 501 and fourth ridges 502, which are disposed over a top surface 503. Like the ridges of the base 113, the third ridges 501 are substantially parallel to one another; and substantially perpendicular to the fourth ridges 502, which are substantially parallel to one another.

The top 111 includes a frame assembly which comprises the third and fourth ridges 501 and 502, respectively. Like the ridges of the base, these ridges are usefully fabricated of a relatively strong and relatively inexpensive material such as wood. As such, in an example embodiment, the ridges 501, 502 are made of 2×4 lumber. Of course, this is merely illustrative, and it is emphasized that the materials noted to be useful for ridges 103 and 104 may be used for ridges 501 and 502 as well. In addition, the top surface 503 may be fabricated of a corrugated material, such as those described above; or other materials referenced as alternatives to the corrugated material. While the top surface 503 is shown adhesively attached to the ridges 501 and 502 in the embodiment of FIG. 5, in another example embodiment, the top 111 may alternatively comprise the ridges 501 and 502 separately from the top surface 503.

In the present example embodiment, the third ridges 501 of the top 111 are disposed in the channel 402 of the hold downs 110; and the fourth ridges 502 are disposed in the slots 106 of the end portions 105 and of the sleeve 109. Like the ridges of the base, the ridges 501 and 502 provide structural rigidity and support in the x-y plane, where the ridges 501 are in the x-direction.

In another embodiment, the third and fourth ridges 501 and 502 may alternatively be adhesively attached to each other and disposed in the slots 106 and the channels 112 of the end portions 105, as well as into the slots 106 of the sleeve 109. Following the disposition of the third and fourth ridges 501 and 502, the top surface 503 may be positioned above and aligned with the sleeve 109 and end portions 105.

Figure 1H:
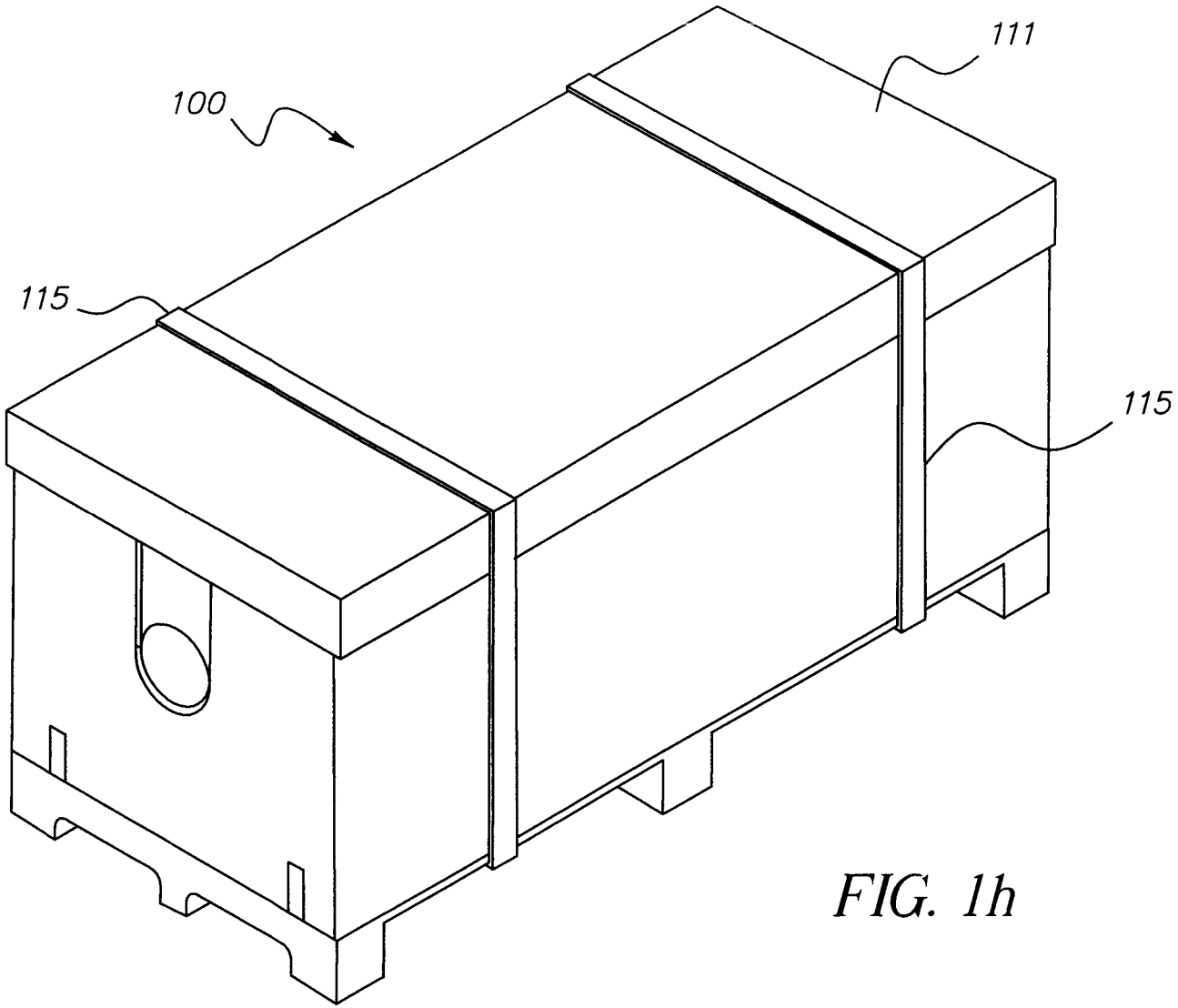
FIG. 1*h* is a perspective view of a package in accordance with an example embodiment.

After the top 111 is disposed, the package is complete. Prior to shipment, fastening bands or straps 115 may be disposed circumferentially about the package 100 as an added measure of securing the structure as shown in FIG. 1*h*.

A packaging apparatus 100 in accordance with another example embodiment is shown and described in connection with FIGS. 6*a* through 6*d*. The 30 packaging apparatus 100 comprises a similar set of parts as illustrated in FIGS. 1*a*-1*h*. It is noted that because many of the features of the present example embodiment are common to those described in connection with the example embodiments described previously, description of such common features is often omitted so as to avoid obscuring the description of the present example embodiment.

Figure 6A:
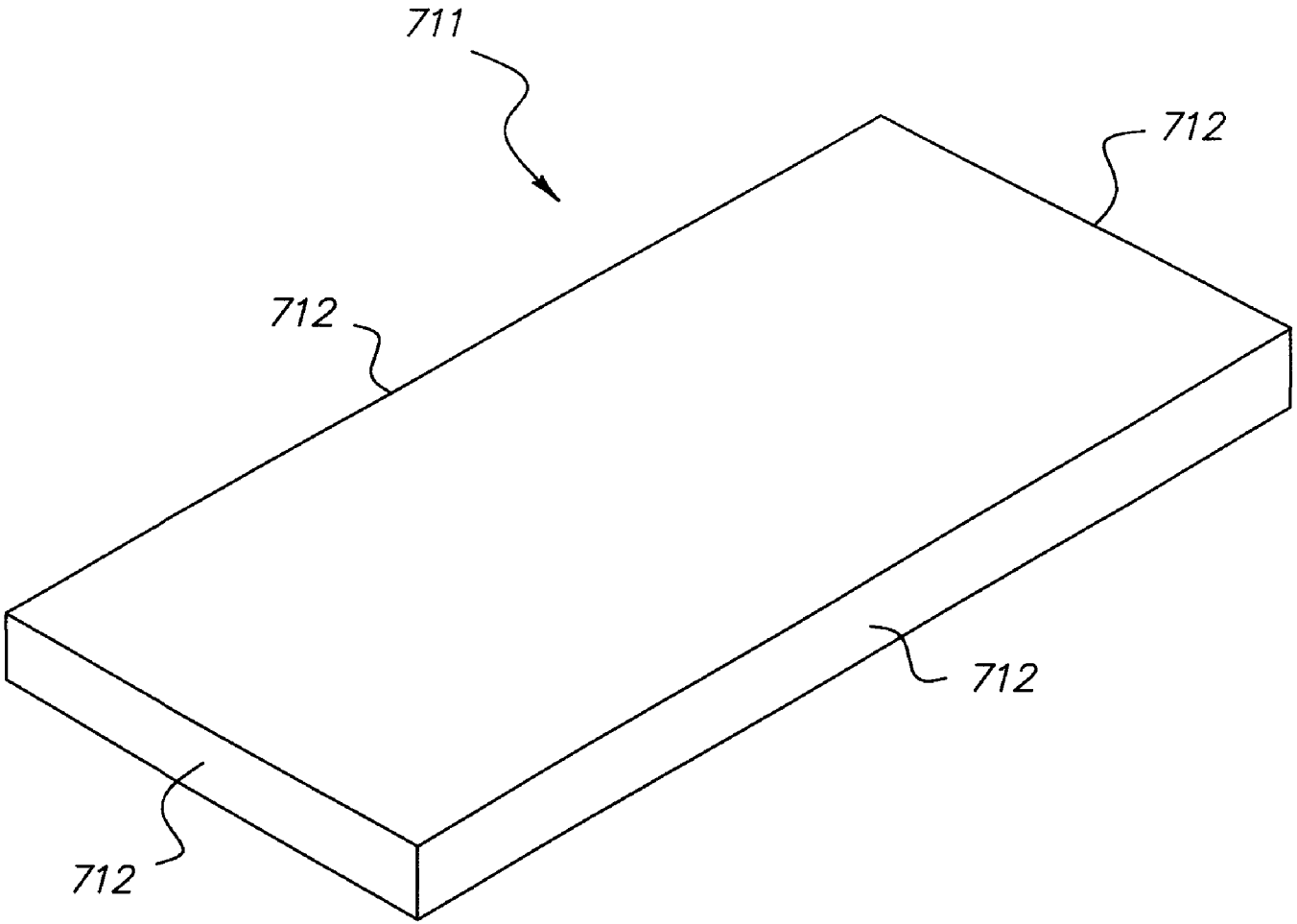
FIG. 6*a* is a perspective view of a top in accordance with a further example embodiment.
Figure 6B:
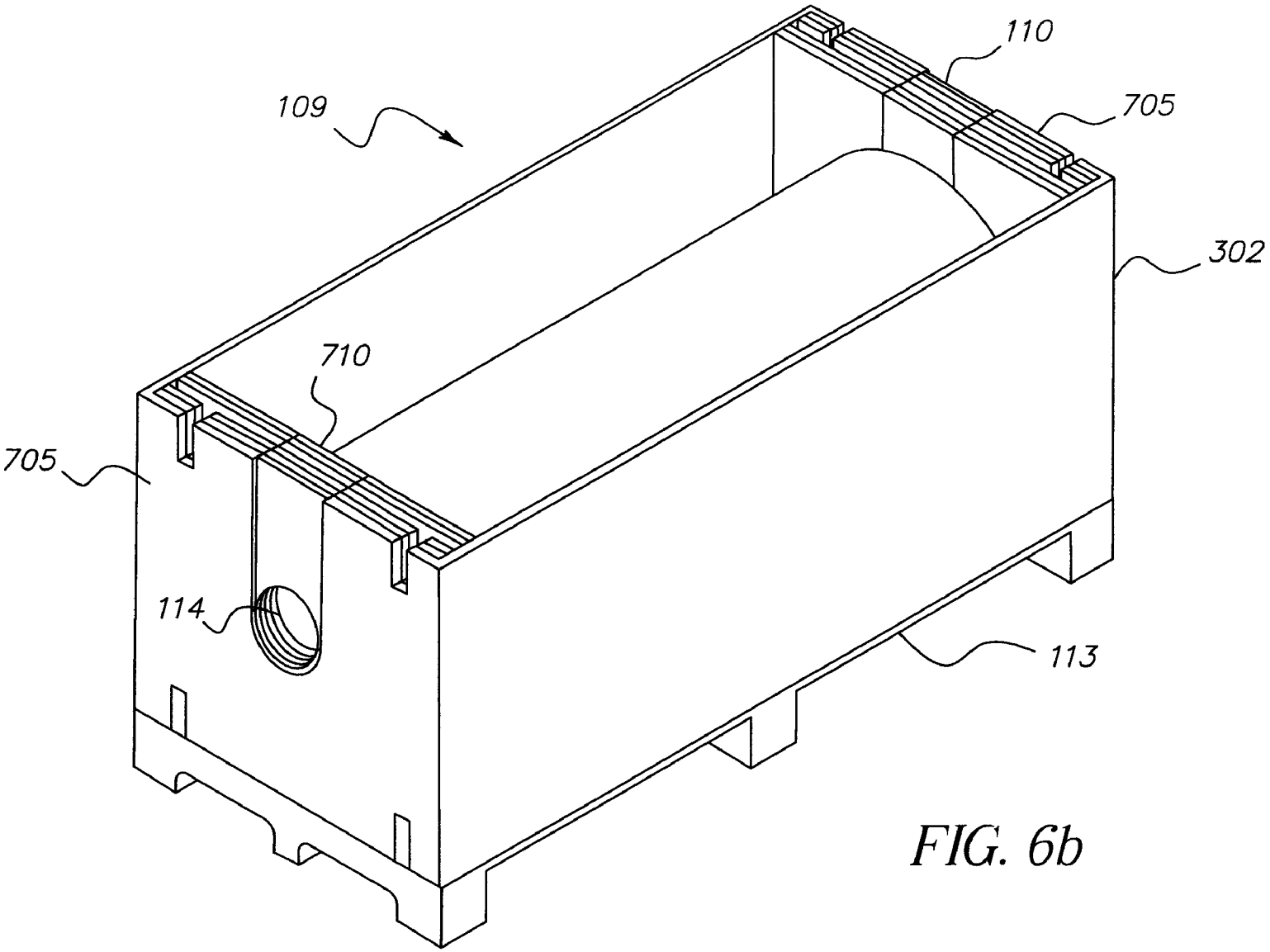
FIG. 6*b* is a perspective view of a further example embodiment with base, end portions, sleeve and hold-down of a package having a roll of material disposed therein in accordance with an example embodiment.

In the present example embodiment, as shown in FIG. 6*a*, the ridges 501 and 502 of the top 711 may be foregone. To this end, the ridges provide structural stability to the top portion of the package 100 by supporting the end portions 105 and the sleeve 109. As such, the ridges 103, 104 and 501, 502 provide structural support via the slots and channels of the components as described above. However, in the present example embodiment, and as shown in FIG. 6*a*, the top 711 comprises a substantially flat top surface and edge parts 712 that also are substantially flat and configured to slide fit over the sleeve 109 and end portions 105 of the shipping box. As shown in FIG. 6*b*, the sleeve 109 is disposed over the base 113 such that sides 302 are on the outside of the end portions 105. The sleeve 109 in combination with the end portions 105 and ridges 103, 104 provide suitable support in the x-y plane so that the ridges 501, 502 are not needed and may be foregone.

Figure 8:
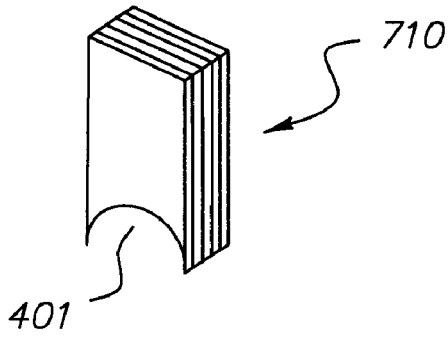
FIG. 8 is a perspective view of a hold down in accordance with an example embodiment.
Figure 7:
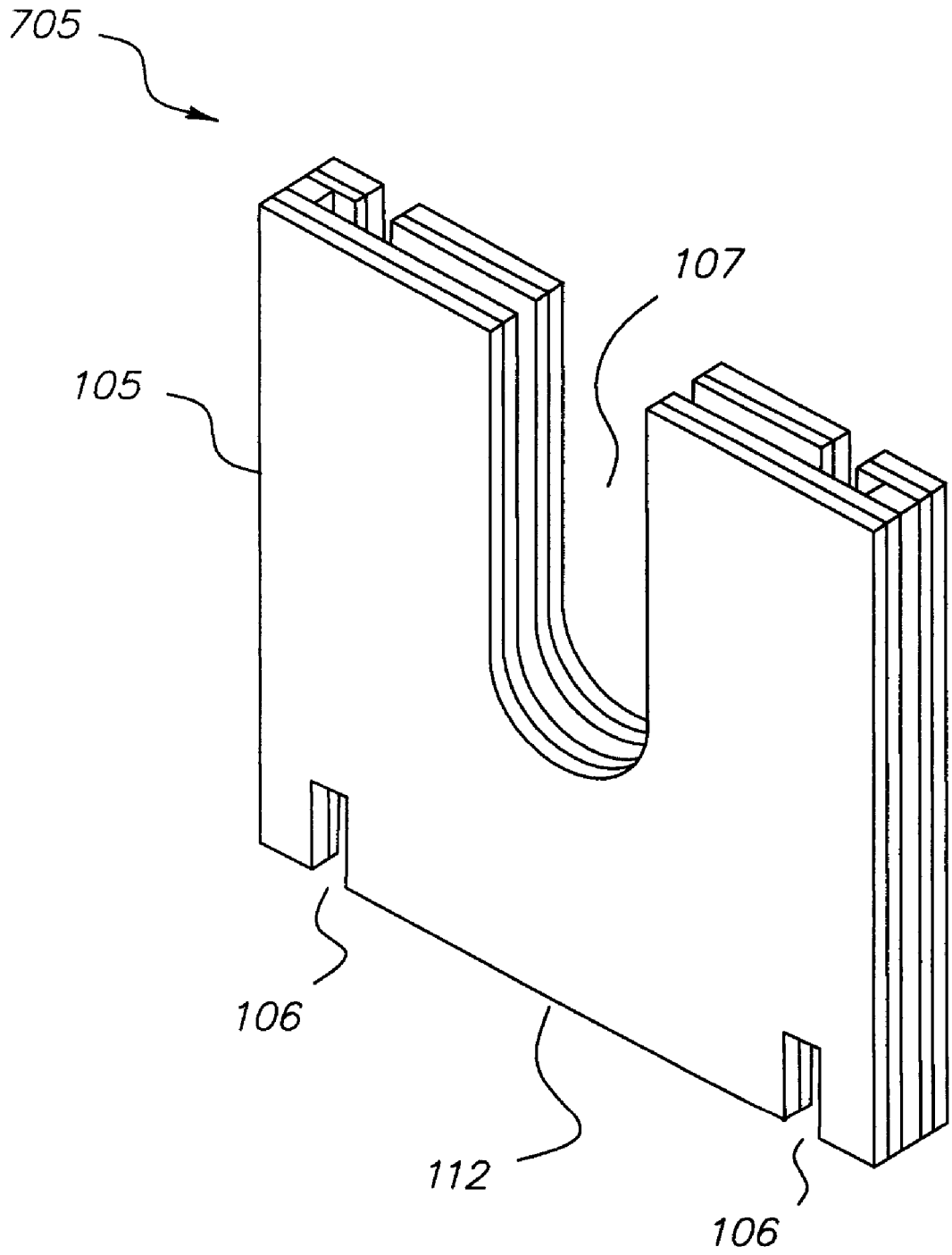
FIG. 7 is a perspective view of an end portion in accordance with an example embodiment.

As shown more clearly in FIGS. 7 and 8, the end portion 705 and the hold down 710 include similar features to the end portion 105 and hold down 110 of the example embodiments described above. Similar numbered items in different figures refer to the same analogous feature. Notably, however, the end portion 705 does not include a channel on its upper surface, but has a lower surface including the channel previously described. Furthermore, the hold down 110 does not include a channel on its upper surface, but does include a lower surface with the curved surface 401 previously described.

Figure 6C:
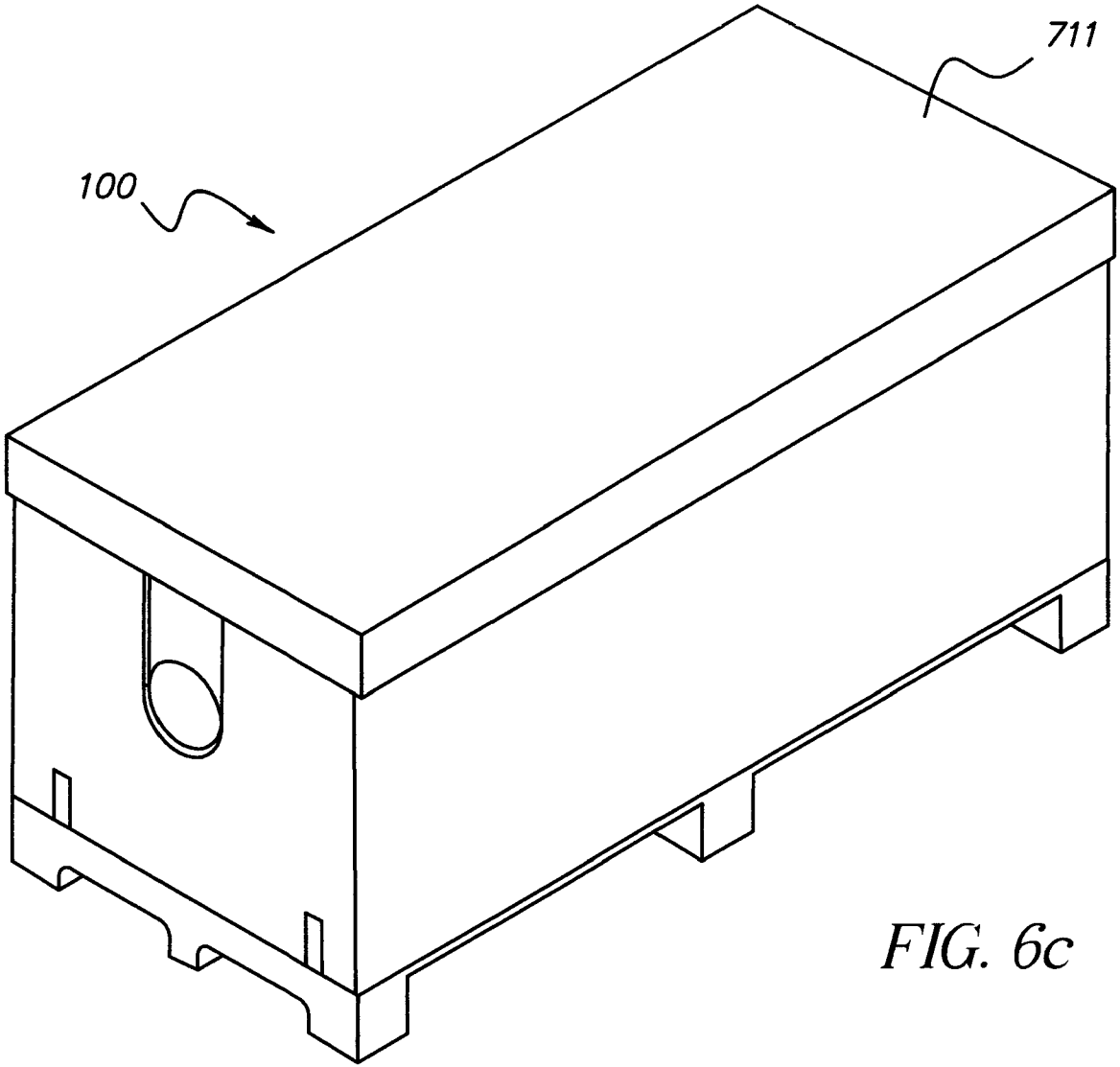
FIG. 6*c* is a perspective view of a package in accordance with an example embodiment.
Figure 6D:
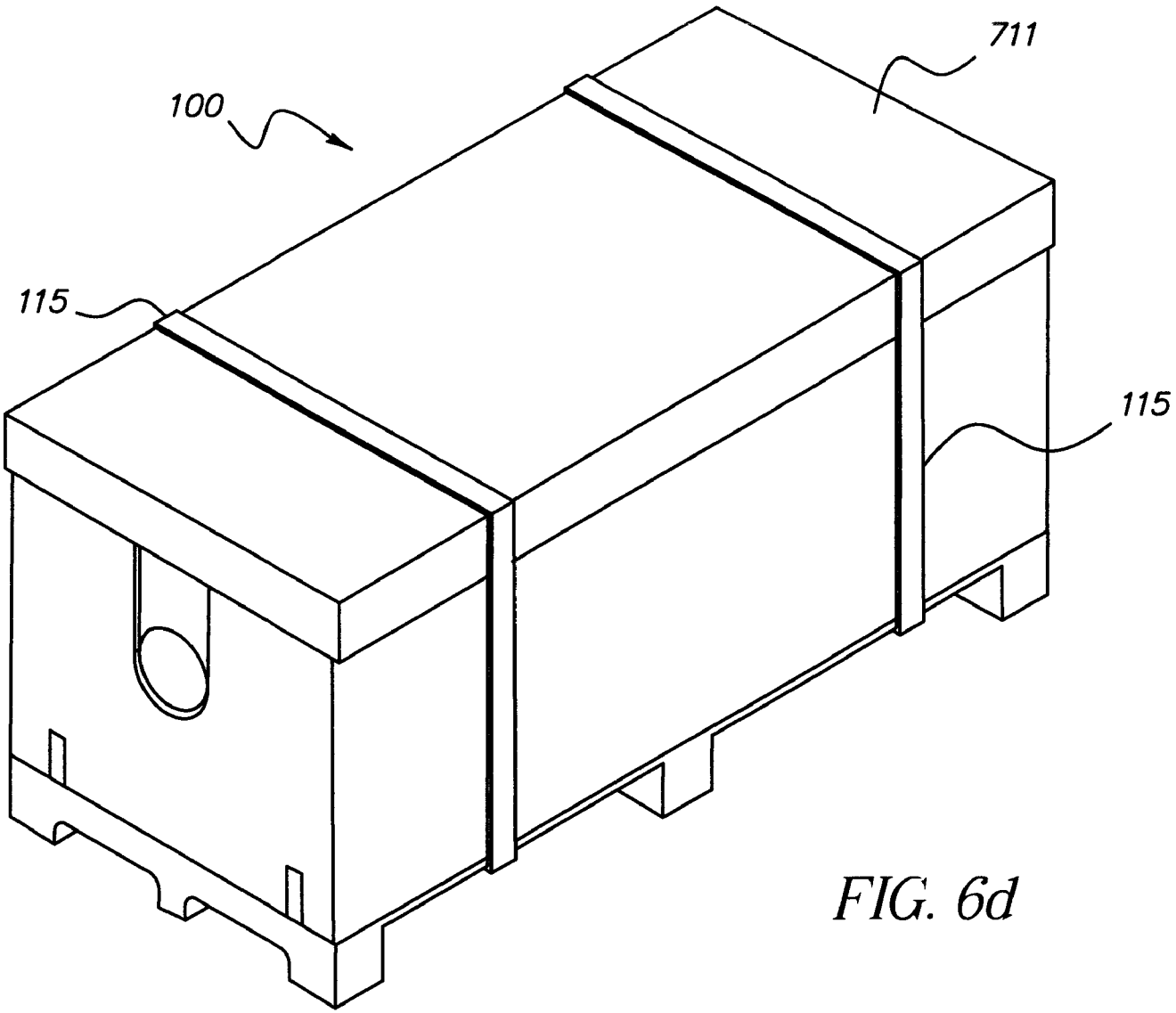
FIG. 6*d* is a perspective view of a package in accordance with an example embodiment.

As shown in FIG. 6*c*, after the top 711 is disposed, the package is complete. Prior to shipment, as shown in FIG. 6*d*, fastening bands 115 or straps may be disposed circumferentially about the package 100 as an added measure of securing the structure.

Figure 9:
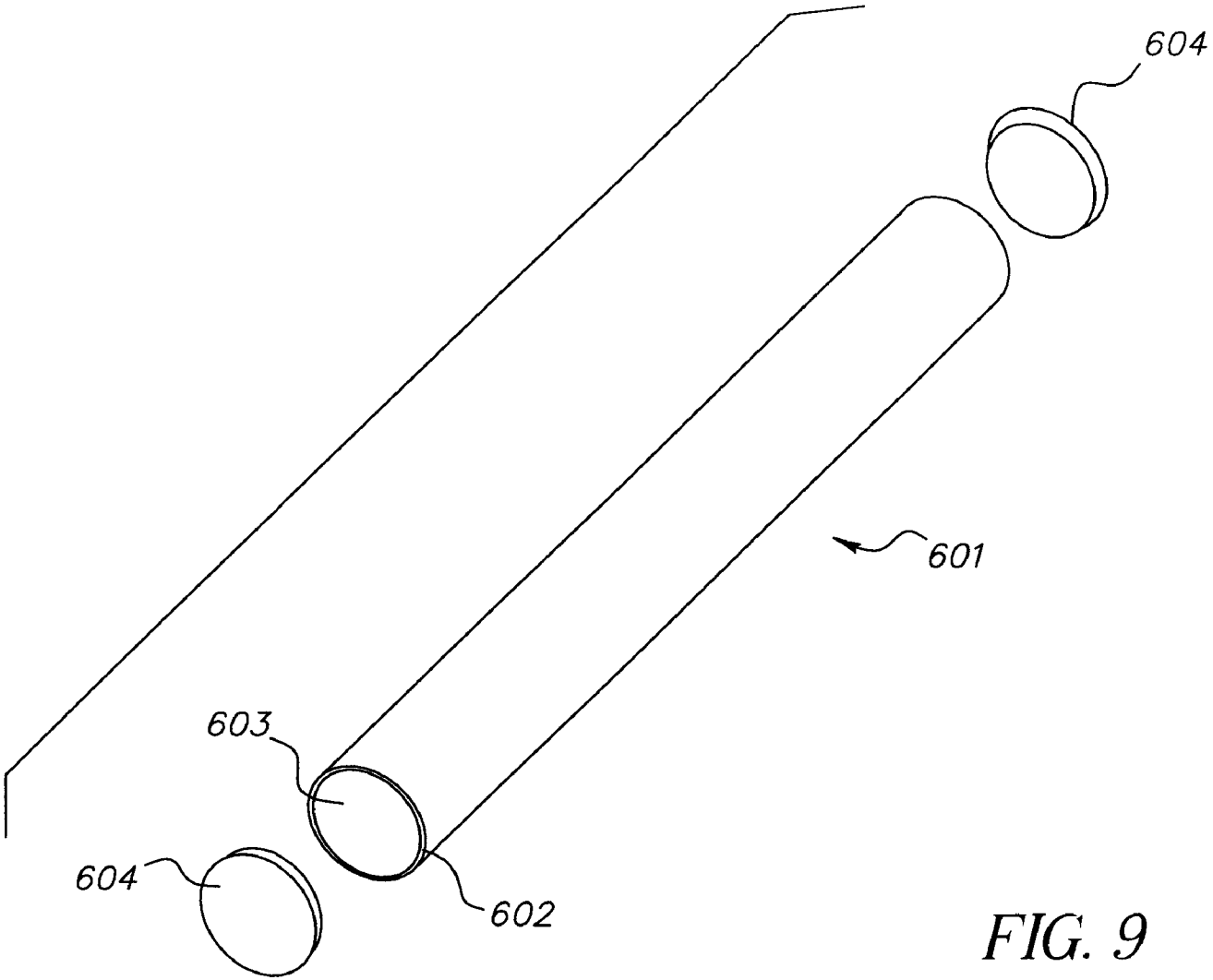
FIG. 9 is a perspective view of a core adapted having end caps.

As described in connection with the example embodiments, a cylindrical core article is supported in the end portions of the package. FIG. 9 illustrates a core 601 in accordance with an example embodiment. The core 601 may be used as the core 114 described in connection with the above example embodiments. In the present example embodiment, the core 601 is cylindrical in shape and substantially hollow. It is noted that the cylindrical shape of the core 601 is merely illustrative. In fact, the core 601 may be of other shapes, including, but not limited to, elliptical and rectangular. Of course, depending on the item being shipped, still other shaped cores may be used. Furthermore, it is possible that some or all of the core 601 is solid or otherwise not hollow. For example, the core may have structural supports or webbing; or may be solid to a point near each end to facilitate the connection of end caps, which are described below.

The core 601 comprises both a wall material 602 forming the cylinder as well as an empty space 603 within the hollow cylinder. As stated, the space 603 defined by the wall material 602 may be throughout the length of the core 601; or a portion thereof. Beneficially this space 603 is readily accessed without the need to open the package. To this end, shipping materials, material samples being shipped, and other articles can be inserted into the space 603 and readily accessed during shipment and upon receipt by the recipient. To protect such shipping materials, samples and other articles, as well as to protect the space 603 from dirt, debris, water and other foreign substances, end caps 604 are provided at each end of the cylindrical core 601. The end caps and core 601 may be formed using plastic, metal, composites, corrugated materials including cardboard and pressed paper and wood products, wherein the end caps illustratively engage an interior surface of the hollow cylindrical core 601 in a snug sliding fit. Alternatively, screw threads, or snaps, or an interference-fit feature. These features are well within the purview of one of ordinary skill in the art. Moreover, other physical engaging surface features well known to those skilled in the packaging arts may be used.

Finally, it is noted that the core 601 may have elements/article disposed therein, thereover, or a combination thereof. These elements include, but are not limited to shipping papers, accessories and tools.

In accordance with illustrative embodiments, a package for transporting articles provides sufficient structural support. The package beneficially is made of relatively inexpensive materials and may be assembled and disassembled substantially without tools. Moreover, after shipment, the package may be collapsed and stored for recycling. The various methods, materials, components and parameters are included by way of example only and not in any limiting sense. In view of this disclosure, those skilled in the art can implement the various example devices and methods to effect improved backlight efficiency, while remaining within the scope of the appended claims.

PARTS LIST

100 package
101 support
102 platform
103 first ridges
104 second ridges
105 end portion
106 slot
107 opening
108 article
109 sleeve
110 hold down element
111 top
112 channel
113 base
114 core
115 fastening bands
301 opening
302 side
401 curved surface
402 channel
501 third ridges
502 fourth ridges
503 top surface
601 core
602 wall material
603 empty space
604 end cap
705 end portion
710 hold down
711 top
712 edge parts

What is claimed is:

1. A packaging apparatus, comprising:

a base having first ridges and second ridges, wherein the first ridges are substantially perpendicular to the second ridges;

end portions, each of which has a plurality of slots and channels, wherein each of the channels is adapted to receive one of the first ridges and each of the slots is adapted to receive one of the second ridges; and a sleeve, which is adapted to be disposed over the base and interiorly to the first ridges, wherein at least a portion of the sleeve and at least a portion of the end portions comprise a corrugated material.

2. A packaging apparatus as recited in claim 1, further comprising a top that includes two or more third ridges and fourth ridges, wherein the third ridges are substantially perpendicular to the fourth ridges.

3. A packaging apparatus as recited in claim 2, further comprising a separate top surface.

4. A packaging apparatus as recited in claim 2, wherein the third and fourth ridges are adhesively attached to said top surface.

5. A packaging apparatus as recited in claim 2, further comprising a hold down, which comprises a channel that is substantially parallel to the third ridges.

6. A packaging apparatus as recited in claim 5, wherein the channel of the hold down is adapted to receive one of the third ridges.

7. A packaging apparatus as recited in claim 1, wherein the sleeve further comprises two sides that are substantially parallel to the second ridges of the base, and each side has one channel that is adapted to engage one of the second ridges.

8. A packaging apparatus as recited in claim 1, wherein the end portions each include an opening through which a core protrudes.

9. A packaging apparatus as recited in claim 8, wherein at least a portion of the core is hollow.

10. A packaging apparatus as recited in claim 8, wherein the core contains an article for transit disposed therein.

11. A packaging apparatus as recited in claim 8, further comprising an end cap, which is adapted to cover an end surface of the core.

12. A packaging apparatus as recited in claim 11, wherein the end cap includes one or more of threads, snaps or interference-fit features.

13. A packaging apparatus as recited in claim 8, wherein the core has an article for transit disposed thereover.

14. A packaging apparatus as recited in claim 8, wherein the core has an article for transit disposed both thereover and therein.

15. A packaging apparatus as recited in claim 13, wherein the article is rolled in a substantially cylindrical shape about the core.

16. A packaging apparatus as recited in claim 2, wherein the end portions each have a top and a bottom, with the slots and the channels in both the top and the bottom.

17. A packaging apparatus as recited in claim 16, wherein each of the slots of the top of the end portion is adapted to receive one of the third ridges.

18. A packaging apparatus as recited in claim 16, wherein each of the slots of the bottom of the end portion is adapted to receive one of the first ridges.

19. A packaging apparatus as recited in claim 16, wherein the channels of the top of the end portions each are adapted to receive one of the fourth ridges.

20. A packaging apparatus as recited in claim 16, wherein the channels of the bottom of the end portions each are adapted to receive one of the second ridges.

21. A packaging apparatus as recited in claim 8, wherein the sleeve further comprises an opening substantially conforming to a cross-sectional shape of the core.

22. A packaging apparatus as recited in claim 8, wherein the sleeve further comprises an opening, which forms a substantially circular opening with the opening of the end portion.

23. A packaging apparatus as recited in claim 1, wherein the material is selected from the group consisting of corrugated cardboard; corrugated plastic; composites of corrugated plastic and wood; laminated wood; wood; plastic; composite materials; and metal.

24. A packaging apparatus as recited in claim 1, further comprising circumferential restraining mechanisms disposed about the apparatus.

25. A packaging apparatus as recited in claim 1, wherein the base is selected from the group consisting of wood, engineered and laminated wood, plastic, composites and metal.

26. A packaging apparatus, comprising:

a base having first ridges and second ridges;

end portions, each of which has a plurality of slots and channels, wherein each of the channels is adapted to receive one of the first ridges and each of the slots is adapted to receive one of the second ridges; and a sleeve element, which is adapted to be disposed over the base and exteriorly to the first and second ridges, wherein at least a portion of the sleeve element, and at least a portion of the end portions comprise a corrugated material.

27. A packaging apparatus as recited in claim 26, further comprising a top that includes a top and four side portions.

28. A packaging apparatus as recited in claim 26, further comprising a hold down.

29. A packaging apparatus as recited in claim 26, wherein the end portions each include an opening through which a core protrudes.

30. A packaging apparatus as recited in claim 29, wherein at least a portion of the core is hollow.

31. A packaging apparatus as recited in claim 30, wherein the core contains an article for transit disposed therein.

32. A packaging apparatus as recited in claim 29, further comprising an end cap cover, which is adapted to cover an end surface of the core.

33. A packaging apparatus as recited in claim 29, further comprising an end cap, which is adapted to cover an end surface of the core.

34. A packaging apparatus as recited in claim 33, wherein the end cap is selected from the group consisting of threads, snaps or an interference-fit feature.

35. A packaging apparatus as recited in claim 29, wherein the sleeve further comprises an opening substantially conforming to a cross-sectional shape of the core.

36. A packaging apparatus as recited in claim 29, wherein the sleeve further comprises an opening, which forms a substantially circular opening with the opening of the end portion.

37. A packaging apparatus as recited in claim 26, wherein the corrugated material is selected from the group consisting of corrugated cardboard; corrugated plastic; composites of corrugated plastic and wood; laminated wood; wood; plastic;, composite materials; and metal.

38. A packaging apparatus as recited in claim 29, wherein the core has an article for transit disposed thereover.

39. A packaging apparatus as recited in claim 30, wherein the article is rolled in a substantially cylindrical shape about the core.

40. A packaging apparatus as recited in claim 26, wherein the end portions each have a top and a bottom, with the slots and the channels in the bottom.

41. A packaging apparatus as recited in claim 40, wherein each of the slots of the bottom of the end portion is adapted to receive one of the first ridges.

42. A packaging apparatus as recited in claim 40, wherein the channels of the bottom of the end portions each are adapted to receive one of the second ridges.

43. A packaging apparatus as recited in claim 26, further comprising circumferential restraining mechanisms disposed about the apparatus.

* * * * *